United States Patent [19]

Nelson

[11] Patent Number: 4,645,359

[45] **Date of Patent: * Feb. 24, 1987**

[54] SIMPLIFIED UNIVERSAL DRAWER GUIDING SYSTEM

[76] Inventor: Gary W. Nelson, 22933 Hatteras St., Woodland Hills, Calif. 91367

[ * ] Notice: The portion of the term of this patent subsequent to Apr. 8, 2003 has been disclaimed.

[21] Appl. No.: 843,197

[22] Filed: Mar. 24, 1986

Related U.S. Application Data

[63] Continuation-in-part of Ser. No. 642,420, Aug. 20, 1984, Pat. No. 4,580,851.

[51] Int. Cl.[4] ..... A47B 88/04; F16C 29/04

[52] U.S. Cl. ..... 384/19; 312/341 R

[58] Field of Search ..... 308/3.6, 3.8; 312/330 R, 338, 341 R, 343, 344, 350; 384/18, 19

[56] References Cited

U.S. PATENT DOCUMENTS

| | | | |
|---|---|---|---|
| Re. 29,222 | 5/1977 | Hosmer | 312/122 |
| 167,161 | 8/1875 | Freese | 312/341 R |
| 466,069 | 12/1891 | Baldwin, Jr. | 312/341 R |
| 524,225 | 8/1894 | Smith | 312/338 |
| 686,777 | 11/1901 | Snook | 312/339 |
| 1,039,548 | 9/1912 | Kral | 312/346 |
| 1,537,067 | 5/1925 | Card | 308/3.8 |
| 1,705,571 | 3/1929 | Jones | 312/339 |
| 1,993,477 | 3/1935 | Gourley et al. | 45/94 |
| 2,273,918 | 2/1942 | Zalkind | 312/261 |
| 2,300,287 | 10/1942 | Huarisa | 179/100.12 |
| 2,534,350 | 12/1950 | Gussack | 308/3.8 |
| 2,582,471 | 1/1952 | West | 312/343 |
| 2,751,272 | 6/1956 | Hutzelman | 312/341 R |
| 2,843,444 | 7/1958 | Nelson | 312/341 |
| 2,859,070 | 11/1958 | Gomersall | 308/3.8 |
| 2,941,847 | 6/1960 | Dargene | 308/3.8 |
| 3,099,501 | 7/1963 | Hillson et al. | 308/3.8 |
| 3,112,960 | 12/1963 | Hillson et al. | 308/3.8 |
| 3,185,530 | 5/1965 | Reiss, Sr. et al. | 308/3.6 |
| 3,186,772 | 6/1965 | Cohn | 308/3.8 |
| 3,328,106 | 6/1967 | Mullin | 312/341 |
| 3,384,431 | 5/1968 | Dargene | 312/343 |
| 3,664,716 | 5/1972 | Johnson | 308/3.8 |
| 3,744,869 | 7/1973 | Anderson et al. | 312/330 |
| 3,836,223 | 9/1974 | Signore | 312/350 |
| 4,125,297 | 11/1978 | Mertes | 308/3.6 |
| 4,196,943 | 4/1980 | Rock et al. | 308/3.8 |
| 4,199,200 | 4/1980 | Livingston | 308/3.8 |
| 4,288,137 | 9/1981 | MacDonald | 312/341 R |
| 4,294,499 | 10/1981 | Rock et al. | 312/334 |
| 4,333,690 | 6/1982 | Keefe et al. | 308/3.8 |

FOREIGN PATENT DOCUMENTS

| | | |
|---|---|---|
| 159098 | 7/1940 | Australia . |
| 2319568 | 11/1974 | Fed. Rep. of Germany . |
| 2622514 | 12/1977 | Fed. Rep. of Germany . |
| 2946113 | 5/1981 | Fed. Rep. of Germany . |
| 3135222 | 3/1983 | Fed. Rep. of Germany . |
| 410069 | 5/1910 | France . |
| 387655 | 5/1931 | United Kingdom . |
| 1135683 | 12/1968 | United Kingdom . |
| 2093334 | 9/1982 | United Kingdom . |

*Primary Examiner*—Stuart S. Levy
*Assistant Examiner*—David Werner
*Attorney, Agent, or Firm*—William W. Haefliger

[57] ABSTRACT

A simplified drawer guiding system includes small rollers carried by tracks attached to a cabinet at each side of a drawer, the small rollers positioned to directly support the drawer under its left and right sides just inside the front of the cabinet; third and fourth rollers projecting at left and right rear corner portions of the drawer for engagement with the respective tracks; and left and right brackets carrying the third and fourth rollers and attached to the drawer left and right side corner portions, at the rearwardmost extent of the drawer.

13 Claims, 24 Drawing Figures

SIMPLIFIED UNIVERSAL DRAWER GUIDING SYSTEM

FIELD OF THE INVENTION

This application is a continuation-in-part of Ser. No. 642,420, filed Aug. 20, 1984 now U.S. Pat. No. 4,580,851.

This invention relates to mounting and guiding arrangements for drawers.

A simplified, universal drawer guide system, in combination with a drawer and a cabinet comprises:

a pair of rollers of relatively small vertical extents, each having a vertical extent of $\frac{3}{4}$ inch or less;

structure for mounting the rollers near the front face of and within the cabinet to engage and support the lower edges of the drawer sides as the drawer is opened and closed;

a pair of metal tracks, one mounted rigidly to the cabinet on each side of the drawer and extending for the length of the drawer;

third and fourth rollers freely projecting at left and right side corner portions of the drawer at the rear thereof for engagement by and into the respective associated tracks; and left and right brackets having plates carrying the respective third and fourth rollers in cantilevered and sidewardly offset relation to the plates and to the drawer sides, the plates flatly engaging the drawer left and right side corner portions, each bracket including holding structure attached to the plate and engaging rear extent of the drawer and attached thereto, each of the third and fourth rollers freely and openly projecting sidewardly from its corresponding plate and outwardly from the drawer side, the mounting structure including a pair of fixed identical brackets secured directly to the tracks for mounting the small rollers onto the tracks for supporting the drawer under its right and under its left-hand sides just inside the front of the cabinet.

BACKGROUND OF THE INVENTION

The conventional type of roller drawer guide includes two pairs of tracks, one mounted on,the drawer, and the other mounted within the drawer cabinet or casing. A first pair of rollers, mounted just within the cabinet and secured to it engages the tracks which are secured to the drawer, and supports the drawer at the front. A second pair of rollers mounted on the left and right sides of the drawer at the rear of the drawer engages the tracks which are secured to the cabinet, and supports the rear of the drawer, with downward force being applied from the roller to the track when the drawer is closed, and upward force being applied from the roller to the track when the drawer is more than half-way extended. This type of prior system is adequate for the purpose, but is somewhat more expensive than would be desirable, in view of the need to use two pairs of tracks one mounted on the drawer, and one mounted on the cabinet, so that four tracks are required, two on each side of the drawer.

With this type of drawer including two pairs of tracks, as discussed above, the space between the outer side of the drawer and the adjacent portions of the cabinet which, support the second rails, is normally about one-half inch. One device which is intended to permit a drawer to be mounted closer to the adjacent cabinet wall, is disclosed in C. W. Koch U.S. Pat. No. 2,223,071, granted Nov. 26, 1940. In order to mount the drawer with its sides closer to the adjacent cabinet walls, the structure shown in the Kock patent utilizes tracks mounted on the cabinet wall above the drawer, with cantilevered rollers supported by brackets extending from the rear of the drawer to locate each roller above and to the rear of the drawer to engage the associated tract. In addition, a separate roller is mounted just inside the cabinet under the lower sides of the drawer. While the device shown in the Koch patent was intended to save space, in actuality, it requires that a relatively shallow drawer be employed, and drawer space is also lost at the rear of the drawer because of the rearward extent of the cantilevered bracket for supporting the rollers which are secured to the drawer. In addition, the drawer arrangements shown in the Koch patent are not compatible with standard drawer and cabinet designs, which include one-half inch spacing between the sides of the drawers and the adjacent walls of the cabinet. Thus, any utilization of the Koch invention would require the full redesign of a cabinet and associated drawers rather than merely substituting one type of drawer hardware for another.

Accordingly, a principal object of the patent invention is to provide an inexpensive drawer roller mounting and supporting system, and one which is compatible with existing cabinet and drawer configurations.

SUMMARY OF THE INVENTION

In accordance with the present invention, a drawer mounting and guiding system includes only two metal tracks, one located on each side of the drawer and secured to the cabinet in the space between the side of the drawer and the cabinet wall. Rollers are secured to the rear of the drawer using a universal bracket design which will fit on both the left and the right-hand rear corners of the drawer, and either at the top or the bottom of the drawer. Two more rollers are mounted on the cabinet adjacent the front face of the cabinet and under the edges of the drawer. These last mentioned rollers are normally of relatively small vertical extent so that extra height is not required between adjacent drawers.

In accordance with an additional feature of the invention, the brackets for holding roller which are secured to the cabinet may also be universal, in that they may be mounted either on the left or right-hand side of the drawer, preferably affixed to the track.

In accordance with another feature of the invention, the universal brackets for securing the rollers to the rear ends of the drawer may be substantially triangular in shape with flanges to extend over a corner of the drawer, whereby they may be mounted on either the left or right-hand side of the drawer, and either at the bottom or the top rear corners of the drawer.

Additional features include the provision of tabs projecting generally at right angles to the plate to engage the rear end of the drawer and to engage the underside of the drawer; the provision of plate edge extents fitting into dado grooving in the drawer near the rear and bottom corner sides thereof; and the provision of means integral with the plates and projecting laterally from within the drawer to the exterior thereof to mount said third and fourth rollers.

If desired, the tracks may be mounted near the upper edge of the drawer or down near its lower edge. In addition, to provide additional support for longer drawers, an extended roller wheel mounting bracket may be provided so that the drawer may still be firmly supported when pulled forward so that it extends for most of its length out of the cabinet.

Advantages of the present invention include the following:

1. Only one pair of tracks is required instead of usual two pairs of tracks which are conventionally employed in roller mounted drawer arrangements.

2. The new hardware is consistent with conventional drawer and cabinet configurations in which approximately one-half inch of space is provided between the side of the drawer, and the adjacent walls of the cabinet.

3. The universal mounting brackets for the rollers on the drawer and also for the fixed rollers underlying the front edges of the drawers, make for low cost tooling and ease in manufacture.

4. The system of the present invention is applicable to very narrow height drawers, the type used in dental offices and the like, where there is not enough vertical space to accomodate two tracks.

5. The disadvantages of the Koch patented device, involving the track which overlies the edges of the drawer and as discussed above, are overcome and avoided.

6. The unsightly metal tracks which are mounted on the sides of drawers in conventional drawer roller mounting arrangements are eliminated.

7. The rollers which are mounted on the cabinet to underlie the front edges of the drawer may be either relatively small diameter rollers of a conventional type having a diameter in the order of ⅝ inch or less, or may be of other configurations having a reduced vertical extent, such as the roller configuration of U.S. Pat. No. 4,236,773, granted Dec. 2, 1980.

Other objects, features and advantages of the present invention will become apparent: from a consideration of the following detailed description and from the accompanying drawings.

DETAILED DESCRIPTION

Figure 1:
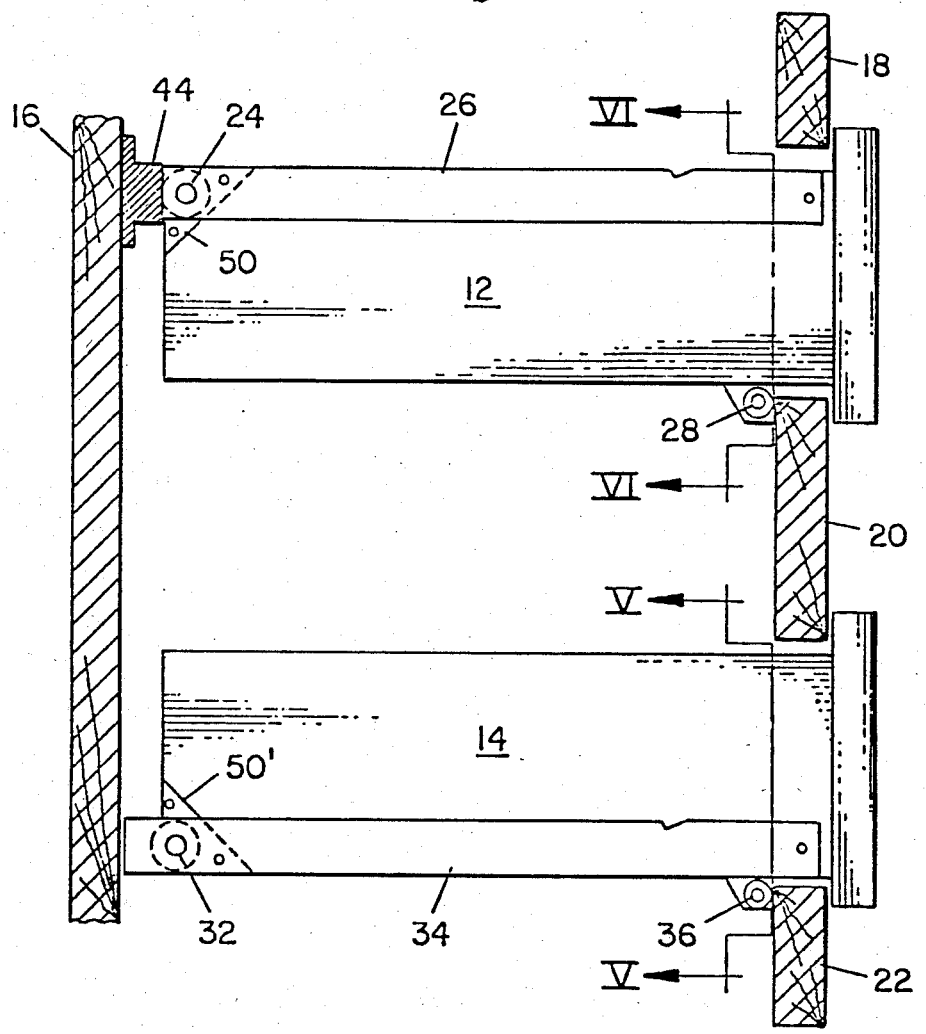
FIG. 1 is a side view of two embodiments illustrating the principles of the invention.

Referring more particularly to the drawings, FIG. 1 is a schematic view showing a pair of drawers 12 and 14 which are mounted in a manner illustrating the principles of the prsesent invention. Incidentally, it is useful to note FIGS. 2, 3, 5 and 6 which all relate to the arrangements shown in FIG. 1. In FIG. 1, the rear of the cabinet is indicated by the wooden member 16, and the cabinet face frame is indicated at 18, 20 and 22 at the right in FIG. 1. The drawer 12 is mounted, supported, and guided by a pair of rollers including roller 24 secured to the rear upper corner of the drawer 12 and which ride within a pair of tracks including the track 26, and the pair of small diameter rollers including roller 28 which are mounted from the cabinet frame, immediately below the front edge of the drawer 12. A second roller is mounted on the upper rear corner of the drawer 12 in a location comparable to that of the roller 24 but on the other side of the drawer, and a second track similar to track 26 is mounted on the other side of the drawer 12. Similarly, with the roller 28 being mounted on the front left side of the drawer 12 to underlie its left-hand edge, a second roller is located on the right-hand side of the drawer to support and guide the right hand edge of the drawer 12.

The roller 32 is mounted on the lower rear corner of the drawer 14, as contrasted with the roller 24 which was mounted on the upper rear corner of drawer 12. The roller 32 is confined within and engages the track 34 which is mounted on one side of the drawer 14 between the drawer and the adjacent supporting frame of the cabinet. As in the case of drawer 12, the drawer 14 is provided with a small roller 36 which is mounted under the front edge of the left-hand side of the drawer.

Figure 2:
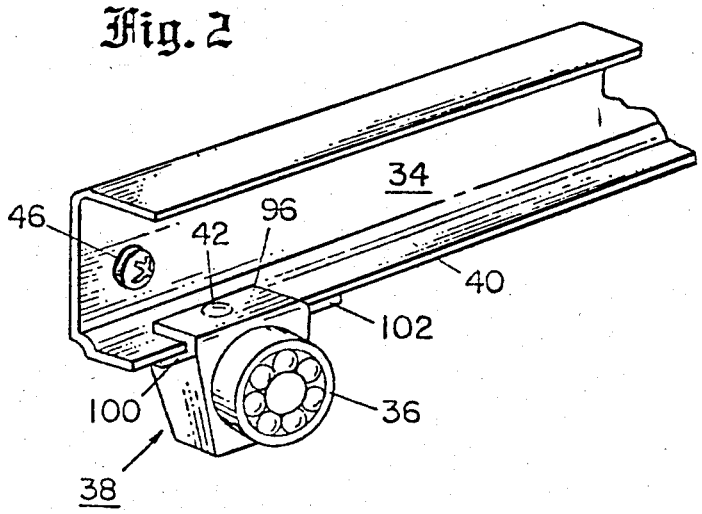
FIG. 2 is an isometric view of the track, and a roller assembly secured thereto, in accordance with the preferred form of the invention.
Figure 5:
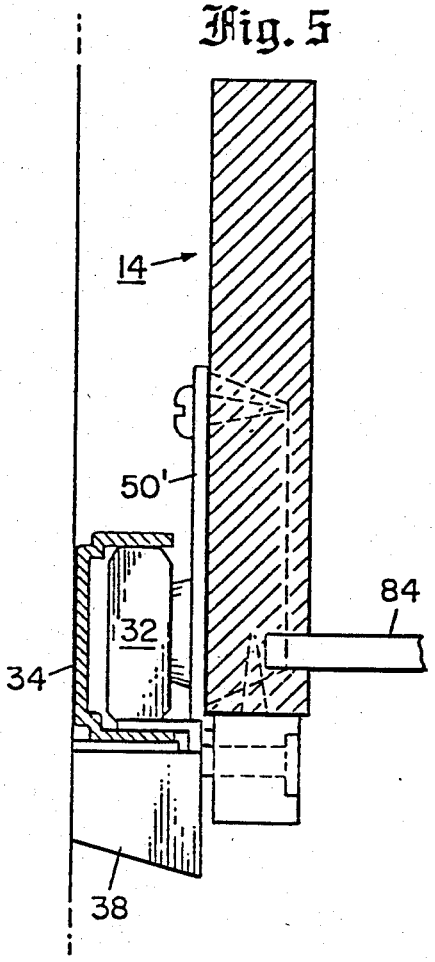
FIG. 5 is a partial cross-sectional view taken along lines V—V of FIG. 1.

The arrangements for mounting the roller 36 are shown to advantage in FIGS. 2 and 5. More specifically, a bracket 38 fits snugly over the lower flange 40 of the rail 34, and is secured thereto by a suitable fastner 42 or by mechanically indenting both the bracket 38 and the rail 40 so that they remain in the interlocked position shown in FIG. 2.

The rails 26 and 34 shown in FIG. 1, may be held in position in any desired manner. Thus, for example, the rear of the track 26 may be provided with a fitting 44 which is secured to the rear frame member 16 of the cabinet. Alternatively, screws such as the screw 46 as shown in FIG. 2 may be employed to secure the rails to the cabinet frame.

Figure 3:
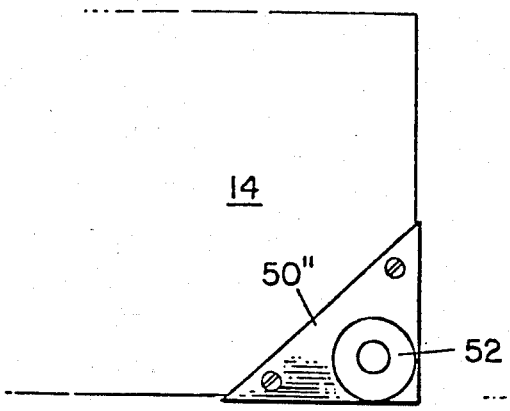
FIG. 3 shows a universal roller mounting bracket secured to the rear lower corner of a drawer.
Figure 7:
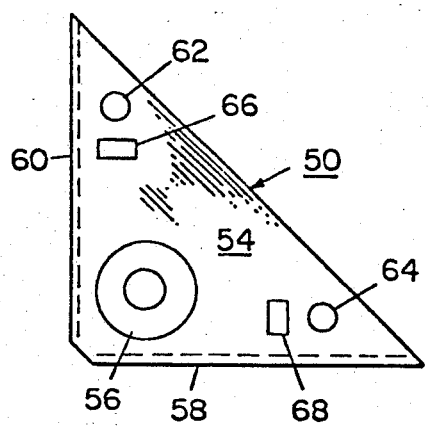
FIG. 7 is a side view of the triangular bracket employed for mounting wheels at the rear corners of the drawer.
Figure 8:
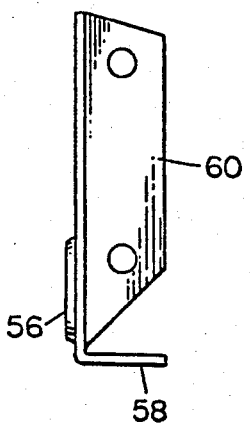
FIG. 8 is an end view of the bracket of FIG. 7.

The roller 24 is mounted on the triangular bracket 50, and the roller 32 is mounted on an identical bracket which is designated by the reference numeral 50'. In FIG. 3, the roller 52 which is mounted on the right rear corner of the drawer 14 is mounted on a bracket designated 50''. The triangular brackets used for the support of the rollers 24, 32, and 52, are all identical and their configuration which permits this universal usage, is shown in FIGS. 7 and 8. More specifically, the bracket 50 includes a plate area 54 having a boss 56 to which the wheel may be secured and a pair of flanges 58 and 60 which are oriented at right angles to one another. Each of the flanges 58 and 60 are provided with openings for securing to the edges of the rear corners of the drawer. The plate 50 is provided with circular openings 62 and 64 for receiving screws, and adjacent rectangular openings 66 and 68 which permit the use of staplers to direct staples through the openings 62, 66 or through the openings 64, 68 when it is desired to secure the bracket 50 to the drawer by means of staples.

It may be readily seen that with the two flanges 58 and 60, and the interconnecting plate 50 to which the roller may be secured, the bracket 50 is "universal" in that it may be secured to either the left or right rear corner of a drawer, and to either the upper or lower corner on each side.

Figure 4:
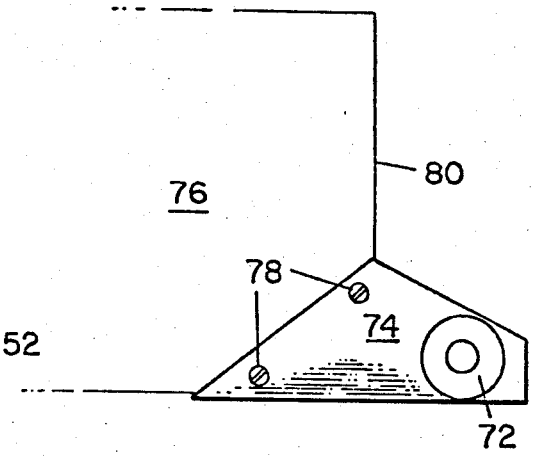
FIG. 4 shows an alternative arrangements with a special bracket for locating the roller which is mounted on the drawer to the rear of the end of the drawer.

FIG. 4 shows an alternative arrangement for mounting a roller 72 on a bracket 74 which is secured to a drawer 76 by two screws 78 so that the roller 72 is mounted well behind the rear 80 of the drawer 76. This arragement shown in FIG. 4 provides increased strength and support to the drawer when the drawer is already quite long, and where there is adequate space within the cabinet for the additional bracket 74, and where it is desired that the drawer be firmly mounted even when fully extended from the cabinet.

Figure 6:
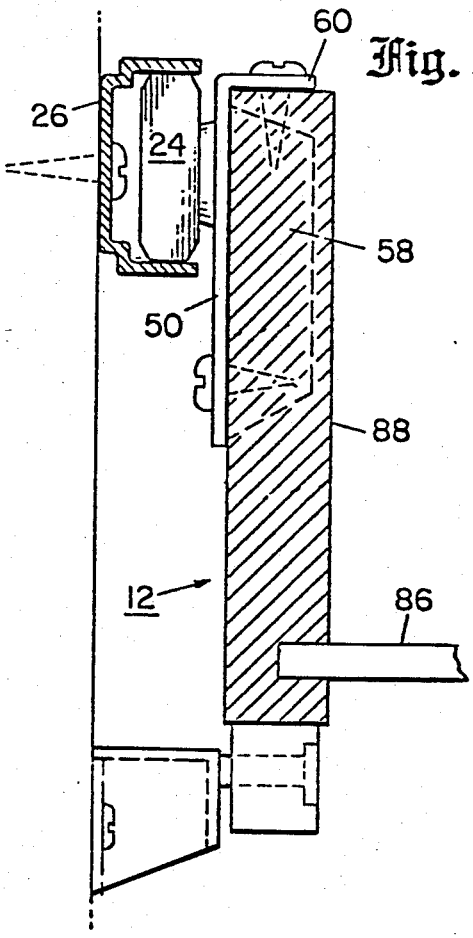
FIG. 6 is a partial cross-sectional view taken along lines VI—VI of FIG. 1.

Incidentally, the drawer 14 of FIGS. 1 and 5 is provided with a bottom 84, while the drawer 12 shown in FIGS. 1 and 6 is provided with a bottom 86. The rail 26 is shown in FIG. 6 enclosing the roller 24, which is secured to the left rear corner of the sidewall 88 of the drawer 12 by the bracket 50. Incidentally, the orientation of the flanges 58 and 60 as shown in FIGS. 7 and 8, are apparent in FIG. 6 of the drawings.

Figure 10:
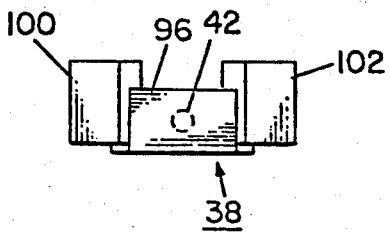
FIGS. 9 through 11 are conventional mechanical views from three different orientations of the bracket for holding the stationary roller at the mouth of the cabinet, on either side thereof.
Figure 9:
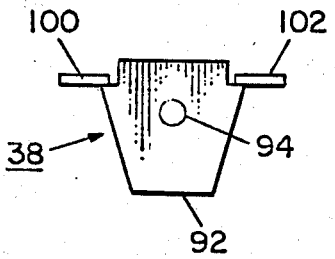
Figure 11:
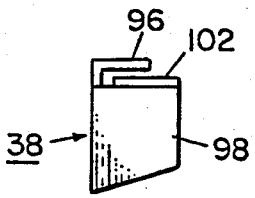

FIGS. 9, 10 and 11 of the drawings show the bracket 38 of FIG. 2 in somewhat greater detail. More specifically, the plate 38 has a main surface 92 having an aperture 94 in which the small diameter rollers are mounted. Bent from the main face plate 92 are various additional members including the upper tab 96 which fits over and engages the lower member of the rail 34 as a result of the detent 42. Sidewalls including the wall 98 and a corresponding wall on the other side, are bent outwardly to provide the arms 100 and 102 which underlie the lower surface of the rail 34 and provide positive engagement with the other side therof in opposition to the tab 96.

It is noted that the bracket 38 may be secured as indicated in FIG. 2 to one end of a rail 34 for use at the left hand side of the drawer. Similarly, it may be secured to the front end of a second rail on the right-hand side of the drawer to support the front right edge of the drawer. Thus, the bracket 38 is universal, in that it may be assembled for use either at the front left or at the front right hand side of the drawer.

Incidentally, for completeness, it is noted that the rollers 24, 32, etc. which are to be employed at the rear corners of the drawer are preferably in the order of one inch or slightly less in diameter; while the small diameter rollers 28, 36, etc. which are to be used at the front of the drawers underlying the sides of the drawers, are preferably in the order of $\frac{5}{8}$ inch in diameter, and are about one-fourth or three-eights inch wide.

Concerning certain collateral aspects of the constructions disclosed herein, a few points are worthy of note. First, concerning drawer stops, to prevent the drawer from inadvertently coming out of the cabinet, stops such as those indicated by the recesses shown on the upper right-hand surfaces of the tracks 26 and 34 of FIG. 1, may be employed. These "out-stops", as they are called, may be either positive out-stops or frictional outstops, where the drawers may be pulled past the out-stop. With regard to another matter, the rollers which are fixed to the cabinet, such as rollers 28 or 36 should be of reduced vertical extent. In this regard, if conventional rollers are employed, the diameter is preferably about $\frac{5}{8}$ inch or less. However, other types of roller supports with relatively small vertical extent may also be used, and one such arrangement using a mushroom shaped roller, is disclosed in U.S. Pat. No. 4,236,773, granted Dec. 2, 1980.

Figure 12:
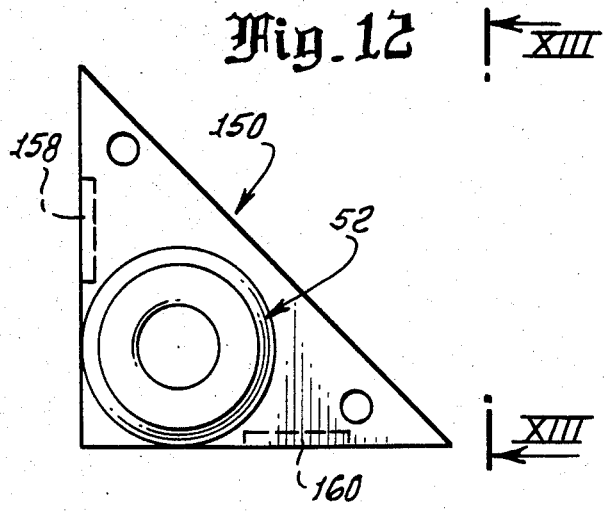
FIG. 12 is a side elevational view of a modified triangular bracket for mounting a wheel at the rear corner of the drawer.
Figure 13:
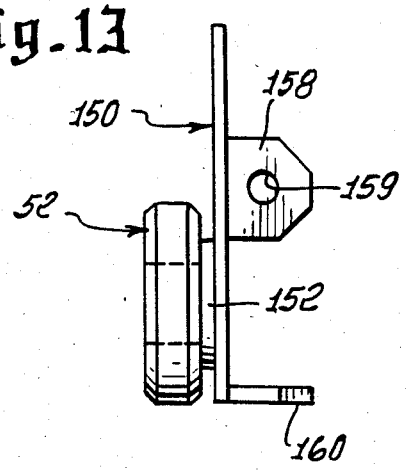
FIG. 13 is an end view taken on lines 13—13 of FIG. 12.
Figure 14:
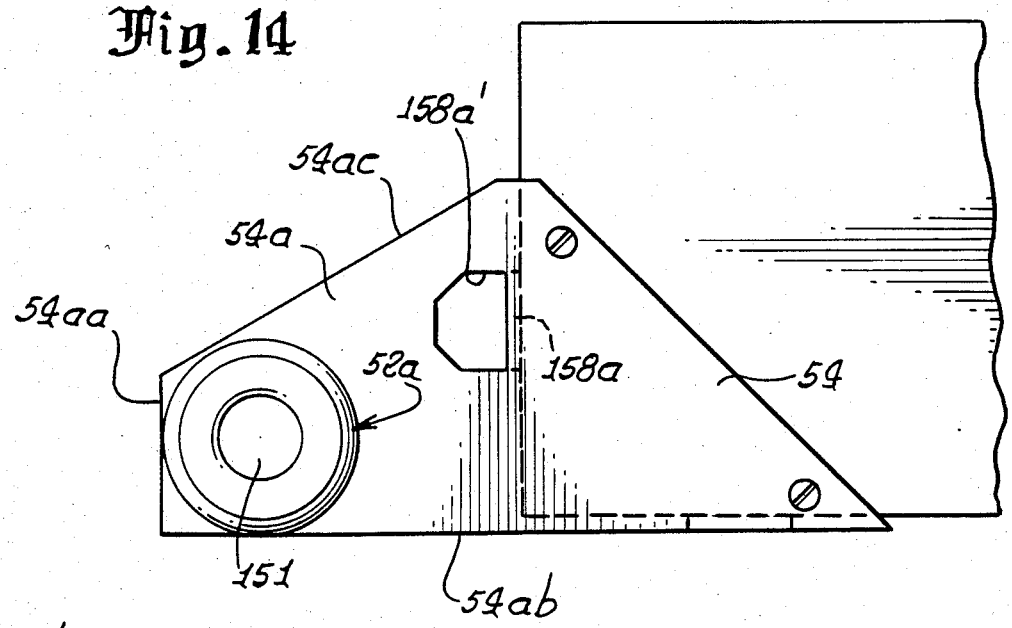
FIG. 14 is a view like FIG. 12 showing a further modified bracket.

Referring to FIGS. 12 and 13, the bracket 150 shown is like bracket 50 of FIG. 7; however, instead of elongated flanges 58 and 60, it has shortened tabular holding flanges, or tabs 158 and 160 to engage attach to the lower rear end, and under rear side of the drawer. Roller axle 151 projects from a stem or boss 152 integral with the bracket plate 54, an supports the roller for rotation. In FIG. 14, the plate and tab structure is the same as in FIGS. 12 and 13; however, the plate 54 has a reduced, cantilevered extent **54*a*, and the roller 52*a* is pivotally supported by plate rearward extent 54*a*, rearwardly of the drawer. This allows greater support for the loaded drawer, as the latter is pulled forwardly to its forwardmost extent. Note plate rear and bottom edges 54*aa* and 54*ab*, and rearwardly and downwardly angled upper edge 54*ac*. Tab 158*a* is punched from plate extent 54*a* to form opening 158*a'*. The tabs may contain fastener openings as at 159**.

Figure 15:
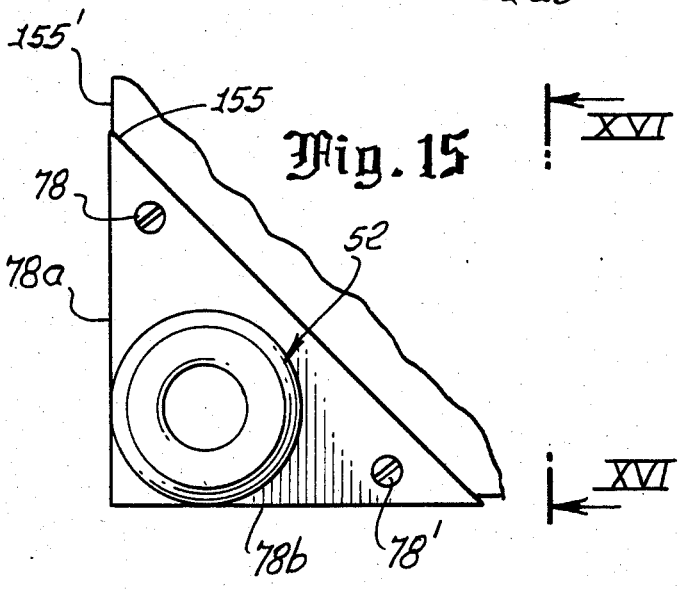
FIG. 15 is a view like FIG. 3 showing the modified triangular bracket.
Figure 16:
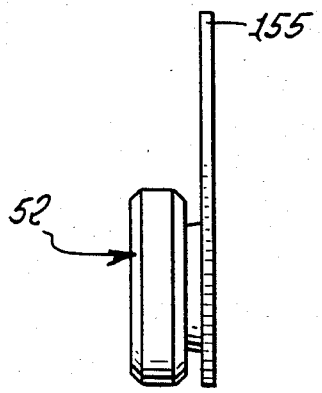
FIG. 16 is an end view on lines 16—16 of FIG. 15.
Figure 17:
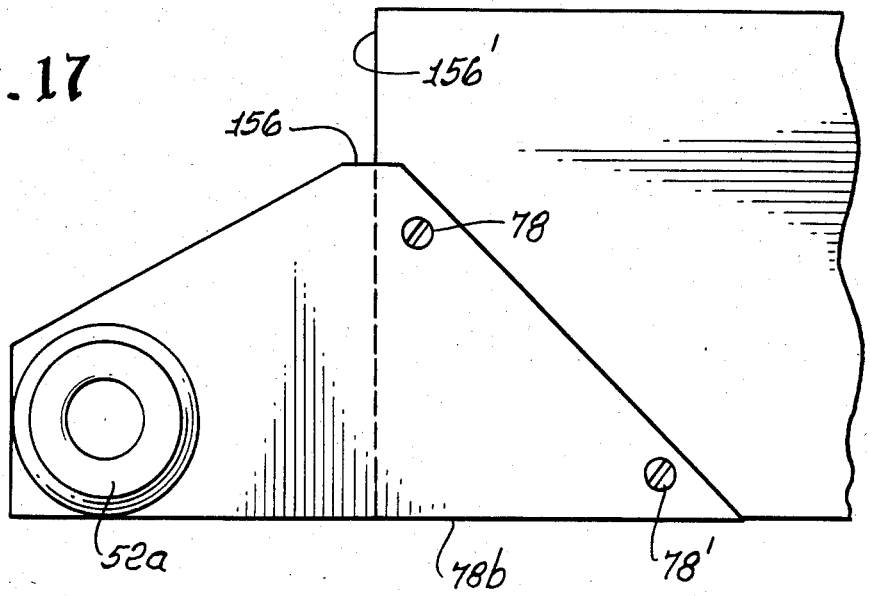
FIG. 17 is a view like FIG. 4, and showing this modification thereof.

Referring to FIGS. 15 and 17, they correspond to FIGS. 3 and 4 and bear the same numerals; however, no flanges or tabs are employed. Fasteners at 78 and 78' attach the plates to the drawer sides, so that plate and drawer rear edges are in registration at **78*a*; and plate and drawer bottom edges are in registration at 78*b*. Plate uppermost extents at 155 and 156 are in registration, or near registration, with drawer rear ends 155' and 156'**.

Figure 18:
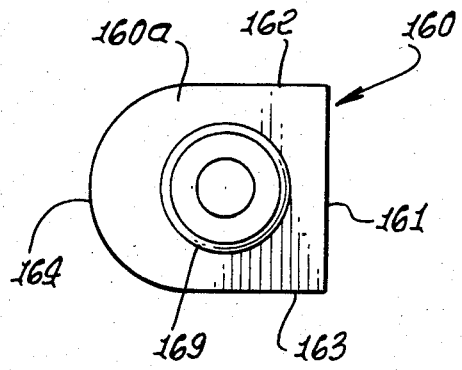
FIG. 18 is a side elevational view of yet another modified bracket.
Figure 19:
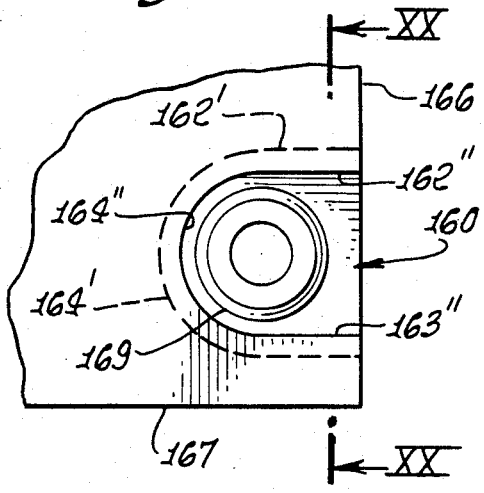
FIG. 19 is a side elevational view showing the FIG. 18 bracket installed in a drawer rear corner.
Figure 20:
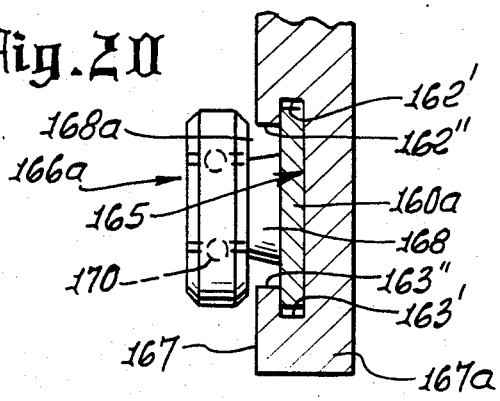
FIG. 20 is a section in elevation on lines 20—20 of FIG. 19.

Referring to FIGS. 18–20, the bracket 160 is in the form of a thin plate **160*a* having three straight sides 161–163, and one convexly rounded side 164. It slides frictionally into a similarly shaped dado groove 165 cut in the drawer rear end 166 just above drawer lower rear edge 167. The groove corresponding outer edges appear at 162', 163' and 164', and inner edges 162'', 163'' and 164''. Thus, plate edge extents fit closely into the groove and define holding structure. Roller 166*a* projects proximate the side 167 of the drawer, and close to plate 160*a* in the groove. Means such as a trunnion 168 is integral with the plate, and projects laterally from within the drawer side panel 167*a*, via side opening 168*a*, to mount the roller for rotation, as about the race 169. Ball bearings, indicated at 170, may mount the roller. If desired, fasteners may be employed to positively attach plate 160***a* to the drawer side panel.

Figure 21:
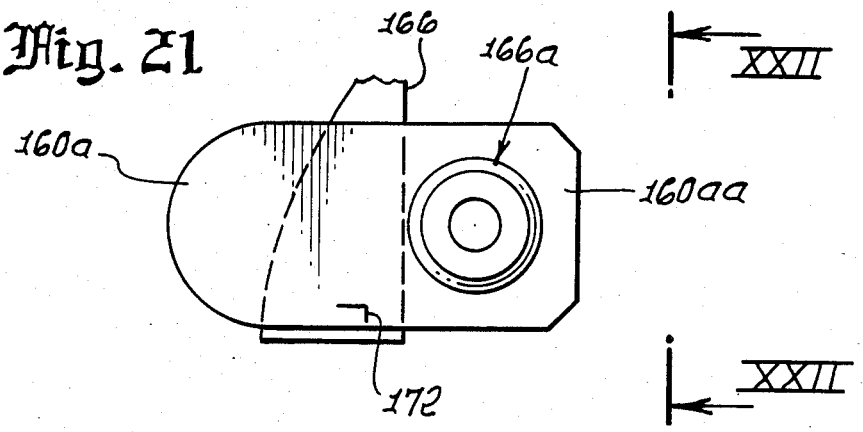
FIG. 21 is side elevation showing a side elevaton of a cantilevered form of the FIG. 18 bracket.
Figure 22:
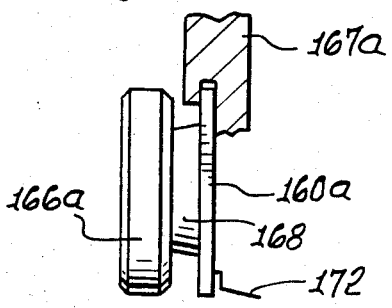
FIG. 22 is an end view on lines 22—22 of FIG. 21.

In FIGS. 21 and 22, the construction is like that of FIGS. 18–20, except that the plate 160*a* has a rearward projection 160*aa* that extends from within the dado groove 165 in the panel 167*a*, to the rear of the drawer. Projection 160*aa* now carries the trunnion 168 and the roller 166*a*, directly rearwardly of the panel rear edge 166. A lock burr 172 on the plate cuts into or interferes with the wooden panel 167*a*, and positively holds the plate in position, in the dado groove.

Figure 23:
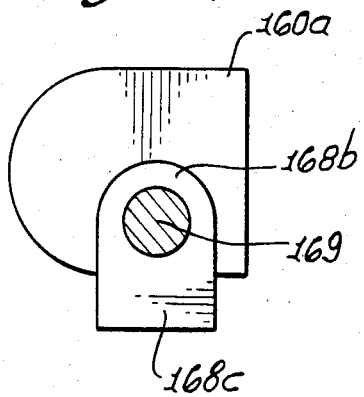
FIG. 23 is a view like FIG. 18 showing a still further modified form of the bracket.
Figure 24:
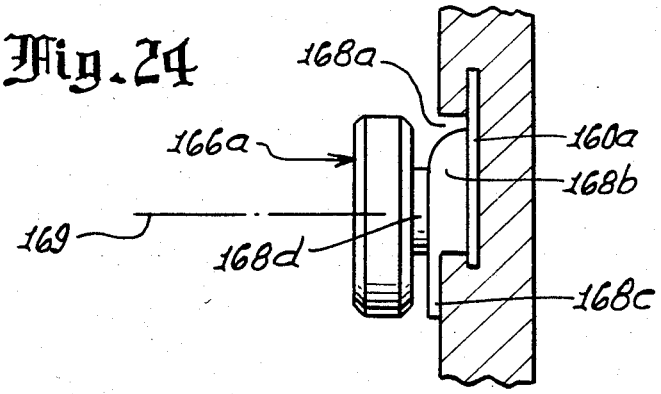
FIG. 24 is an end elevation showing the FIG. 23 bracket installed in a drawer rear corner.

In FIGS. 23 and 24, the construction is again like that of FIGS. 18–20, except that the modified trunnion 168*b* projects sidewardly from the plate, in opening 168*a*, and then downwardly at 168*c*. The roller mounting outer portion 168*d* of the trunnion is offset downwardly relative to opening 168*a*, so that the axis 169 of rotation of roller 166*a* intersects the lowermost portion of mounting plate 160*a*, as shown.

In conclusion, it is to be understood that the foregoing detailed description and the accompanying drawings relate to illustrative embodiments of the invention. Various departures from the precise arrangements shown may be realized. Thus, by way of example and not of limitation, instead of using brackets for the rear corners of the drawers which are precisely triangular, these universal roller supports may be formed with a curved internal surface of their main plate, or this main plate could be rectangular in shape. It is also noted that the drawers could be of lesser height than those shown, with the present invention being applicable to drawers having heights which are in the order of 1¾ inches, for example. In addition, the bracket 38 could be formed in other symmetrical configurations wherein there is engagement both for the upper and lower surface of one edge of the rail, but not precisely in the form shown in FIGS. 9 through 11. In addition, low friction side play control elements, which may be of molded plastic, may be employed to prevent the drawer sides from contacting the metal tracks. Accordingly, it is to be understood that the present invention is not limited to that precisely as shown and described hereinabove.

I claim:

1. A simplifed, universal drawer guide system in combination with a drawer and a cabinet comprising:

a pair of rollers of relatively small vertical extents means for mounting said rollers near the front face of and within the cabinet to engage and support the lower edges of the drawer sides as the drawer is opened and closed;

a pair of metal tracks, one mounted rigidly to the cabinet on each side of the drawer and extending for the length of the drawer;

third and fourth rollers freely projecting at left and right side corner portions of said drawer at the rear thereof for engagement by and into the respective associated tracks; and left and righ brackets having plates carrying the respective third and fourth rollers in cantilevered and sidewardly offset relation to the plates and to the drawer sides, the plates flatly engaging the drawer left and right side corner portions, each bracket including holding structure attached to the plate and engaging rear extent of the drawer and attached thereto, each of the third and fourth rollers freely and openly projecting sidewardly from its corresponding plate and outwardly from the drawer side;

said mounting means including a pair of fixed identical brackets secured directly to said tracks for mounting the small rollers onto said tracks in directly supporting relation iwth the drawer under its right and under its left-hand sides just insides the front of the cabinet, each of said small rollers being substantially sidewardly offset from a downward continuation of the space between the drawer and cabinet;

each of said left and right brackets including said holding structure being entirely confined at rearwardmost extent of the drawer.

2. The combination of claim 1 wherein said holding structure includes fasteners projecting from the plate into the drawer near the rear end thereof and near the underside thereof.

3. The combination of claim 2 wherein each said plate is right triangular in outline.

4. The combination of claim 2 wherein each said plate has rearward extents that project rearwardly from the drawer, and said third and fourth rollers are carried by said rearward extents.

5. A simplified, universal drawer guide system in combination with a drawer and a cabinet comprising:

a pair of rollers of relatively small vertical extents;

means for mounting said rollers near the front face of and within the cabinet to engage and support the lower edges of the drawer sides as the drawer is opened and closed;

a pair or metal tracks, one mounted rigidly to the cabinet on each side of the drawer and extending along the length of the drawer;

third and fourth rollers freely projecting at left and right side corner portions of said drawer at the rear thereof for engagement by and into the respective associated tracks; and left and right brackets having plates carrying the respective third and fourth rollers in cantilevered and sidewardly offset relation to the plates and to the drawer side, the plates flatly engaging the drawer left and right side corner portions, each bracket including holding structure attached to the plate and engaging rear extent of the drawer and attached thereto, each of the third and fourth rollers freely and openly projecting sidewardly from its corresponding plate and outwardly from the drawer side, said mounting means including a pair of fixed identical brackets secured directly to said tracks for mounting the small rollers onto said tracks for supporting the drawer under its right and under its left-hand sides just inside the front of the cabinet, said holding structure attached to each plate including tabs projecting generally at right angles to the plate to engage the rear end of the drawer and to engage the underside of the drawer.

6. The combination of claim 5 wherein each said plate is right triangular in outline.

7. The combination of claim 5 wherein each said plate has rearward extents that project rearwardly from the drawer, and said third and fourth rollers are carried by said rearward extents.

8. A simplified, universal drawer guide system in combination with a drawer and a cabinet comprising:

a pair of rollers of relatively small vertical extents;

means for mounting said rollers near the front face of and within the cabinet to engage and support the lower edges of the drawer sides as the drawer is opened and closed;

a pair of metal tracks, on mounted rigidly to the cabinet on each side of the drawer and extending along the length of the drawer;

third and fourth rollers freely projecting at left and right side corner portions of said drawer at the rear thereof for engagement by and into the respective associated tracks; and left and right brackets having plates carrying the respective third and fourth rollers in cantilevered and sidewardly offset relation to the plates and to the drawer sides, the plates flatly engaging the drawer left and right side corner portions, each bracket including holding structure attached to the plate and engaging rear extent of the drawer and attached thereto, each of the third and fourth rollers freely and openly projecting sidewardly from its corresponding plate and outwardly from the drawer side:

said mounting means including a pair of fixed identical brackets secured directly to said tracks for mounting the small rollers onto said tracks for supporting the drawer under its right and under its left-hand sides just inside the front of the cabinet:

said holding structure including plate edge extents fitting into dado grooving in the drawer near the rear corner sides thereof.

9. The combination of claim 8 wherein said third and fourth rollers project proximate the sides of the drawer and close to said plates located in the drawer.

10. The combination of claim 8 wherein said plate projects from within the drawer to the rear of the drawer, and said rollers are carried by plate portions rearwardly of the drawer rear corners.

11. The combination of claim 8 including means integral with the plates and projecting laterally from within the drawer to the exterior thereof to mount said third and fourth rollers.

12. The combination of claim 11 wherein said means mounts the rollers to have axes of rotation that intersect lowermost portion of the plates.

13. The combination of claim 8 including a lock burr on the plate extent fitting into the dado groove, and interfering with the drawer material to lock the plate in the groove.

* * * * *